US005788621A

United States Patent [19]

Eady

[11] Patent Number: 5,788,621

[45] Date of Patent: Aug. 4, 1998

[54] METHOD AND APPARATUS FOR CENTRIFUGAL SEPARATION OF SOLIDS FROM MUD AND COMPACTION

[76] Inventor: Robert Ernest Charles Eady, Lookout Hill, Oraika, State Highway 1, Whangarei, New Zealand

[21] Appl. No.: 750,885

[22] PCT Filed: Jun. 20, 1995

[86] PCT No.: PCT/NZ95/00055

§ 371 Date: Dec. 13, 1996

§ 102(e) Date: Dec. 13, 1996

[87] PCT Pub. No.: WO96/00128

PCT Pub. Date: Jan. 4, 1996

[30] Foreign Application Priority Data

Jun. 23, 1994 [NZ] New Zealand ..... 260829
Jul. 25, 1994 [NZ] New Zealand ..... 264083

[51] Int. Cl.[6] ..... B04B 11/04; B04B 11/08

[52] U.S. Cl. ..... 494/37; 494/2; 494/55; 494/56

[58] Field of Search ..... 494/1, 37, 50–52, 494/55, 84, 56, 2; 210/380.1

[56] References Cited

U.S. PATENT DOCUMENTS 1,062,216 5/1913 Berrigan ..... 494/55 X
4,155,503 5/1979 Sears .
4,950,219 8/1990 Luchetta .
5,037,373 8/1991 Mozley ..... 494/55
5,338,285 8/1994 Omori ..... 494/55

FOREIGN PATENT DOCUMENTS 2 094 676 9/1982 United Kingdom .

*Primary Examiner*—Charles E. Cooley
*Attorney, Agent, or Firm*—Merchant, Gould, Smith, Edell, Welter & Schmidt, P.A.

[57] ABSTRACT

A method and apparatus for centrifugal solids separation for use in the drilling industry, concerned with the conservation of drilling mud. The apparatus comprises a rotatable container, a device for inputting used mud to the container preferably with minimal turbulence, a collection device for collecting and compacting separated solids material, a device for wiping separated solids material from the sides of the container and preferably directing this material to the collection a device and an output from the container for cleaned mud. So that the apparatus may be employed for continuous mud cleaning or solids separation, the collection device may be isolated from the container to allow dumping of collected solids material. Where there are multiple collection compartments there may be a synchronised cycle of dumping of the collection device to maintain balance of the container during continuing centrifugal rotation.

22 Claims, 3 Drawing Sheets

METHOD AND APPARATUS FOR CENTRIFUGAL SEPARATION OF SOLIDS FROM MUD AND COMPACTION

TECHNICAL FIELD

This invention relates to a method and apparatus for the separation of solids, and in particular rock cuttings, from drilling muds by centrifugal means.

BACKGROUND ART

In this specification the term "mud" is defined according to its usual meaning in the oil and gas drilling industries, namely to describe a drilling fluid used to transport rock cuttings from a wellbore. Such fluids or mud formulations are tailored to specific wellbore conditions and are costly to formulate. One objective in the process of drilling is, therefore, to conserve drilling muds.

In practice this objective of preserving drilling mud conflicts with a need to remove as much of the drill cuttings from the mud as possible. The accumulation of fine drill solids in muds can only be tolerated to a certain limit, beyond which the required properties of the mud decline.

One conventional form of separating cuttings from drilling muds is the use of shale shakers. These are vibrating screen devices through which the mud is passed. The finest possible screen sizes are required to maximise solids rejection. However, other factors such as mud circulation rate, drilling rate and type of formation being drilled must also be taken into consideration when selecting the screen size. Shale shakers are often operated near the limit of their capability. Thus, when drilling conditions change, whole mud loss occasionally occurs as equipment capabilities are exceeded. Shale shaker screens, especially in the fine mesh sizes, have a limited life expectancy and are costly to replace. Late replacement of torn screens also allows drill solids to accumulate in the mud system leading to higher chemical treatment costs.

In conventional systems shale shakers are often augmented with secondary solids removal devices, including hydrocyclones and partial flow decanting centrifuges. Hydrocyclones, due to inherent characteristics, discharge a relatively high proportion of mud along with the solids which they separate. They are often not maintained in efficient working condition due to blockages and wear on cone liners. Their use is restricted to low to medium density muds.

Conventional decanting centrifuges used for separating mud can be highly sophisticated. The sophistication of this equipment can also make it sensitive and vulnerable to breakdown. As a result such machinery can be unreliable, which is a significant problem where full flow implementation is required. Centrifuges are thus seldom used in full flow implementation and typically process only 10 to 15% of the circulating mud volume.

Shale shakers and hydrocyclones both introduce aeration points into the mud circulation system. The uptake of atmospheric oxygen increases the corrosion rate in the equipment, especially in drill pipes, and catastrophic failure can result from such corrosion.

To eliminate entrained gases from the mud system, conventionally equipped drilling rigs use a separate degasser. Some degasser types are not efficient in eliminating gas microbubbles from the mud system.

An additional complication in modern drilling occurs where sophisticated directional drilling equipment is used, in particular with downhole mud motors. Some types of mud motors are particularly sensitive to erosion by sand-sized drill cuttings in the drilling fluid. This is problematic mostly in tophole drilling where well deviation is initiated and where shale shaker capacity is often insufficient to allow for the use of fine mesh screens, thus resulting in the build up of undesirable concentrations of sand-sized particles in the drilling mud. Mud motor life is reduced under these conditions. If it were possible to maintain the drilling mud free of sand at all times, the life expectancy of existing mud motors would be improved and different, superior types of mud motors could be used.

A further shortcoming of conventional solids removal equipment is the inability to completely remove associated mud adhering to separated cuttings. This is particularly important with oil-based muds when used in environmentally sensitive areas. Strict effluent discharge regulations in such areas can prevent the use of oil-based muds due to the quantity of oil retained on discharged cuttings.

In the oil industry, this problem has been addressed by the use of solvent extraction and "torbed reactor" steam cleaning technology which can reduce oil retention to virtually nil. However, these technologies require separate, complex and expensive pieces of equipment. The additional space required for such equipment can be a problem, especially on oil rigs, and the substantial costs can only be justified to enable drilling to be performed in environmentally sensitive areas.

Thus, there are problems with conventional drilling equipment associated with mud loss from mud separation equipment, corrosion of the equipment due to aeration, incomplete degassing, unreliability of equipment, inadequate separation of fine solids material from drilling mud and incomplete stripping of mud from discharged solids. In addition, generally, separate equipment is required to encompass the functions of conventional shale shakers, degassers, hydrocyclones decanting centrifuges and oil-base mud cuttings cleaning systems.

It is an object of the present invention to reduce at least some of the abovementioned problems or at least to provide the public with a useful alternative.

Other objects of this invention will become apparent from the following description which is given by way of example only.

DISCLOSURE OF INVENTION

According to one aspect of this invention there is provided a centrifugal solids separator adapted to separate drill cuttings from mud in a continuous drilling operation comprising:

(a) a container rotatable about its longitudinal axis;

(b) at least one materials input means for the input of mud and solids material to an inlet area of the container;

(c) wiping means adjacent an internal surface of the container, rotatable about an axis coincident with that of the container and adapted to wipe deposited solids material from sides of the container at a solids separation area of the container during centrifugation;

(d) at least one collection means interconnectable with and rotatable with the container and adapted to receive and compact wiped solids material during centrifugation;

(e) control means adapted to control the depth of mud pool in the container during centrifugation; and (f) at least one discharge outlet for the recovery of cleaned mud from the container.

Preferably the container may be cylindrical.

In a preferred form, the or each collection means may comprise a chamber, and may be positioned between the inlet area and the discharge outlet for cleaned mud.

In one preferred form the or each chamber may include discharge means at an outer end of said chamber and an inner plate adapted to isolate the chamber from the rest of the container, whereby the collection chamber may be isolated from the rest of the container and any collected and compacted solids material discharged through the discharge means without discontinuing centrifugation.

In one preferred form the collection means may comprise a single annular chamber about a part of the container. Alternatively, where multiple collection means are used there may be an even number, evenly spaced about the container, and material may be discharged substantially simultaneously from opposing pairs of collection means to maintain equilibrium.

In a further preferred form of the invention, means may be provided to input the mud and solids material adjacent the sides of the container. Preferably via a central member positioned in the central longitudinal arms of the container, and radial arms extending towards the container sides. The central member and radial arms may be adapted to input the mud and solids material at a rate of rotation similar to that of the container.

In a preferred form of the separator of the invention the wiping means may also be adapted to direct wiped solids material towards the collection means. Preferably the wiping means may be affixed to and rotate with the central member which may rotate at a different rate to the container, hence producing the required wiping action of the wiping means on the container sides.

In a preferred form of the present invention the control means may comprise one or more weir plates.

Preferably the rotatable container and collection chambers have friction-reducing inner surfaces to restrict any build-up of solids material.

In one preferred form the separator of the present invention may further comprise a rotational drive means to rotate at least the container. This or a separate drive means may independently drive the central member in embodiments incorporating this feature.

Preferably the centrifugal solids separator of the present invention may include a degassing function wherein a sealing means with an evacuation or gas extraction outlet is provided to substantially seal the container, in use, from the atmosphere, said evacuation or gas extraction outlet for removal of entrained gases released from mud by partial evacuation of the sealed container during centrifugation.

A substantially sealed container with gas extraction outlet, of the embodiment having that feature, has an advantage over conventional degassing systems in that entrained gas bubbles are exposed to high centrifugal force, thus greatly enhancing breakout of such bubbles.

Preferably the sealing means may comprise a plate or plates extending from the longitudinal axis towards the sides of the container, adjacent an outer part or parts of the solids separation area, whereby when the separator is in use the or each plate extends into the mud pool. The plate may be stationary or may rotate with the core.

The inclusion of this degassing function avoids the need for a separate degasser.

According to an alternative aspect of the invention there is provided a centrifugal solids separator adapted to separate drill cuttings from mud (as hereinbefore defined) in a continuous drilling operation comprising:

(a) a cylindrical container rotatable about its substantially vertical axis;

(b) at least one materials input means for the input of mud and solids material to an inlet area at a lower part of the container;

(c) wiping means adjacent an internal surface of the container, rotatable about an axis coincident with that of the container and adapted to wipe deposited solids material from sides of the container at an upper solids separation area of the container during centrifugation and direct this solids material to at least one collection means;

(d) at least one collection means interconnectable with and rotatable with the container and and adapted to receive wiped solids material during centrifugation, and positioned between the inlet area and the discharge outlet for cleaned mud;

(e) control means at an upper part of the container, adapted to control the depth of the mud pool in the container during centrifugation; and (f) at least one discharge outlet above the control means for recovery of cleaned mud from the container.

According to another aspect of the invention there is provided a method of continuously separating drill cuttings from mud comprising:

(a) inputting used mud to a container;

(b) rotating the container to produce a cylindrical mud pool in the container and to deposit solids material on the sides of the container, by centrifugal force;

(c) wiping the deposit of solids material from the sides of the container during centrifugation;

(d) collecting and compacting the wiped solids material in at least one collection means during centrifugation; and (e) recovering cleaned mud via at least one discharge outlet of the container.

Preferably the method of the invention may further comprise controlling the depth of mud pool in the container when in use.

Preferably the method may further comprise dumping of collected solids material at intervals in a dumping cycle and during continuing centrifugation.

In a further preferred form, the method of the present invention may further comprise at least partial evacuation of the container when in use to facilitate the removal of entrained gases from mud during centrifugation.

According to a further aspect of the present invention there is provided cleaned mud produced by a centrifugal solids separator or method of the present invention.

By varying the dimensions of the container and collection chamber(s), separators of the present invention may be constructed for use with weighted or unweighted (no barite) muds. In one preferred form, most suitable for weighted muds, the collection chamber(s) may have a low profile or be of reduced depth, so that the difference in centrifugal force between the container wall and discharge gates of the collection chamber(s), when the separator is in use, is minimised.

It is envisaged that the apparatus of this invention may be preceded by a gumbo grid for the removal of clay balls which may otherwise block the materials input means. In addition, a scalping shale shaker system, with very coarse screens, may be employed between the gumbo grid and the solids separator to allow for the routine collection of drill cuttings for geological analysis. Such a coarse screening device will also reduce erosion of any friction-reducing inner surfaces of the solids separator, and will increase the time taken to fill the collection chamber(s) with solids material thus reducing wear and tear on mechanical parts.

Conventional fine screen shale shakers and hydrocyclones will not be required with the apparatus of the present invention, thus eliminating a number of points of aeration, and reducing the risk of corrosion.

Further it is anticipated that extraneous mud loss and mud retention on cuttings will be substantially reduced in the apparatus of the present invention. In effect, a centrifugal solids separator of the present invention performs two separate functions: continuous full-flow centrifugation to separate out solids material from mud in the body of the container; and semi-batchwise compaction of the separated solids material in the collection chamber(s) to reduce mud retention which is particularly important with oil-based muds.

Further aspects of the present invention will become apparent from the following description which is given by way of example only, and with reference to the accompanying drawings.

MODES FOR CARRYING OUT THE INVENTION

Figure 1:
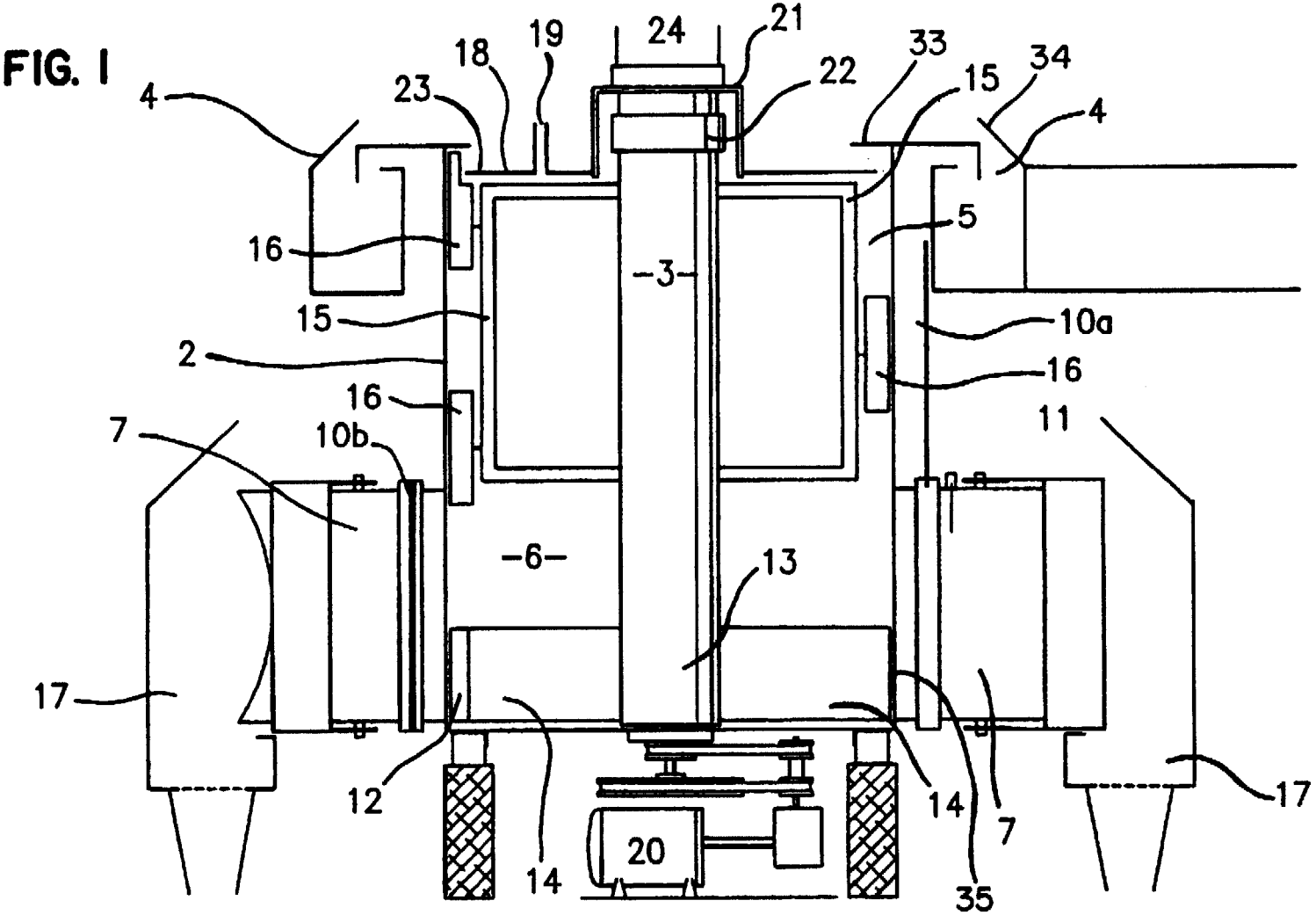
FIG. 1: is a diagrammatic representation showing a vertical cross-section of a preferred form of the centrifugal solids separator.

With reference to FIG. 1, the centrifugal solids separator 1 principally comprises a rotatable container 2, a rotatable core 3, discharge outlets 4 for the recovery of cleaned mud and a rotational drive means 20.

The drive means 20 may be adapted to drive the container 2 and core 3 at different rotation speeds, or alternatively independent drive means may be provided to drive the container and core separately. It is envisaged that the drive means may be a hydraulic drive system permitting continuous variation in rotational speed as may be required for different mud conditions, although it will be appreciated that the invention is not restricted to any particular type of drive means.

The rotatable container 2 comprises an upper substantially cylindrical region 5 in which solids separation occurs and a lower region 6 adapted to form collection chambers 7, evenly spaced about the circumference. The lower region 6 includes an inlet area 35.

Figure 2:
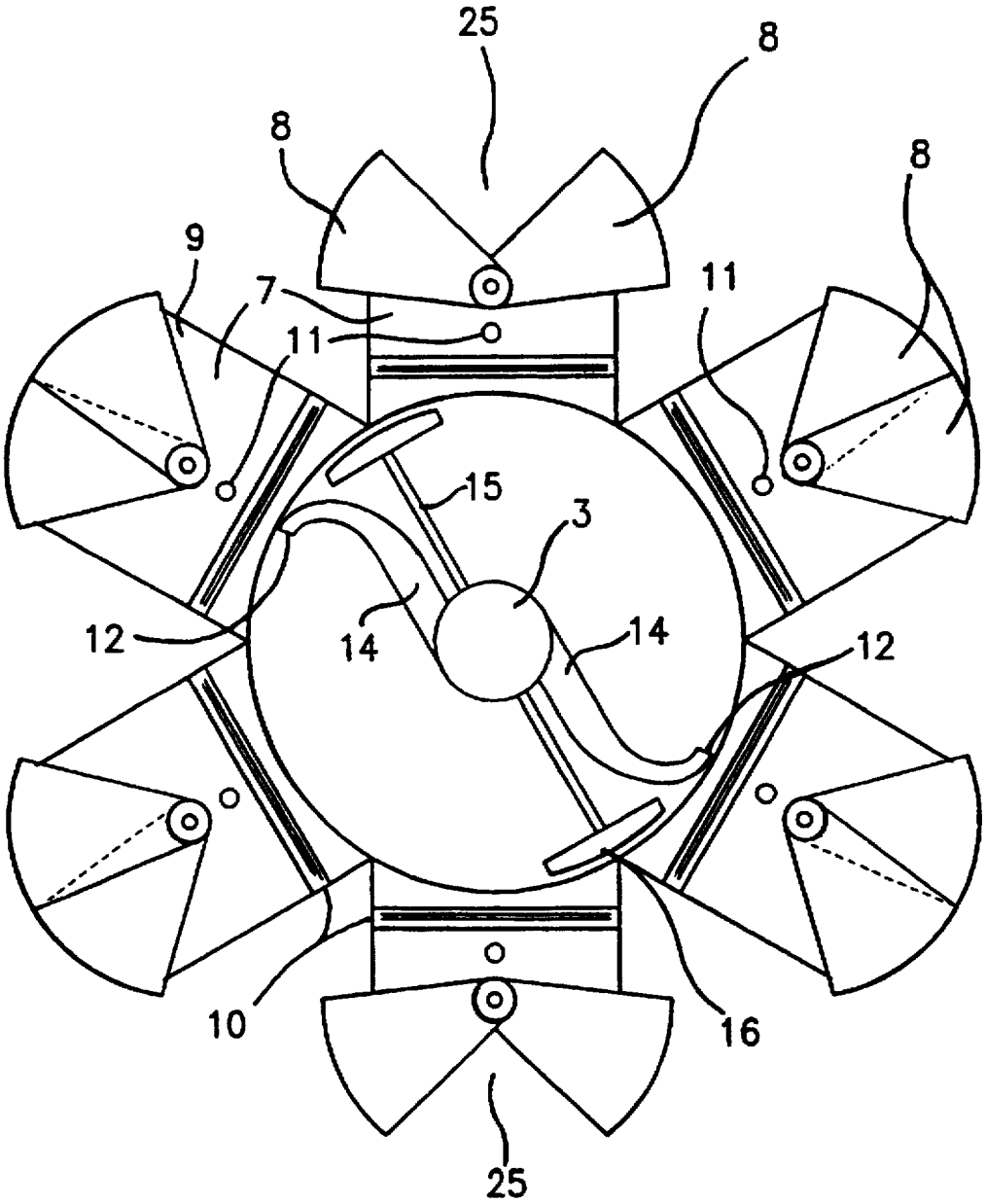
FIG. 2: is a diagrammatic view from above of the centrifugal solids separator of FIG. 1 showing the container with three pairs of collection chambers.

Now referring to FIG. 2, the collection chambers 7 are formed in opposing pairs. Each collection chamber 7 has discharge gates 8 at its outer end 9. In addition, each chamber 7 has an inner plate 10 adapted to isolate the chamber 7 from the rest of the container 2. The discharge gates 8 may be electrically driven. One of each opposing pair of chambers 7 has a sensor 11 to sense the quantity of solids material in the chamber.

The discharge gates 8 of the collection chambers 7 provide a solids material discharge means from the chambers, solids material being discharged into dumps 17.

For structural strength, each collection chamber 7 may have a set of internal and external braces (not shown in the drawings).

Figure 3:
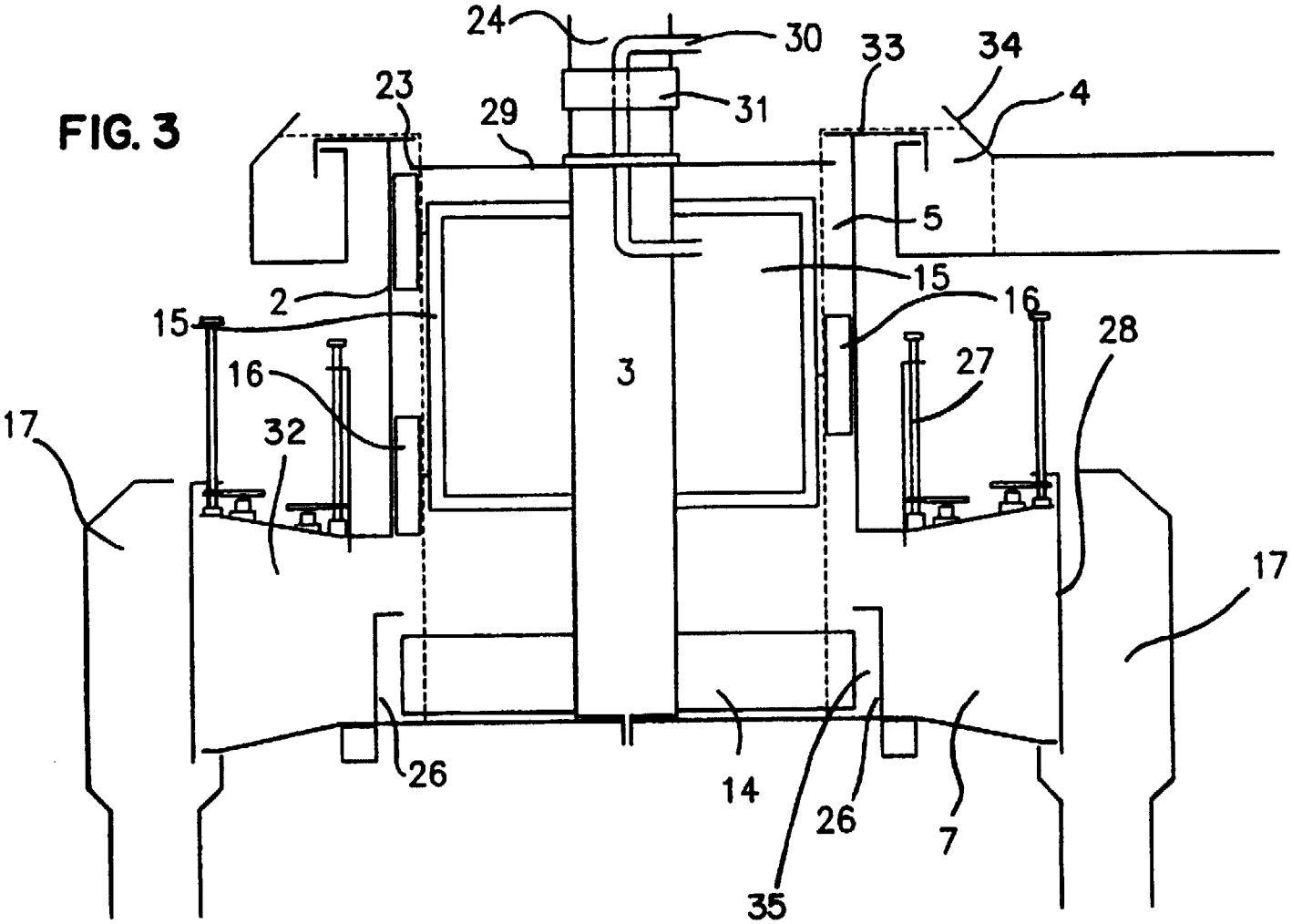
FIG. 3: is a diagrammatic representation showing a vertical cross-section of an alternative form of the centrifugal solids separator.

In the alternative form of separator 1 shown in FIG. 3 there is a single annular collection chamber 32 having an inner plate 27 in the form of a cylinder, moveable vertically, and a discharge gate 28 also in the form of a cylinder, moveable vertically. Both the inner plate 27 and the discharge gate 28 may be electrically, hydraulically or pneumatically driven.

Reverting to FIG. 1, the rotatable core 3 carries materials input means 12 at its lower end 13. These material input means 12 are at the outer end of lower radius arms 14. There may be any number of lower radius arms 14 providing they are evenly spaced about the circumference of the material input means 12.

Upper radius arms 15, attached to an upper part of the core 3, carry wiping means 16 adapted to dislodge solids material from the substantially cylindrical region 5 of the container 2, and to direct solids material to the lower region 6 of the container 2 during rotation of the container 2 and core 3 at different rotation speeds.

Although in the example of the invention shown in FIGS. 1 and 2 the wiping means 16 are wiper blades, which are preferably oblique-set, it will be understood that alternative forms of wiping means are envisaged, for example, a conventional scroll-type wiping means.

Referring again to FIG. 1, a stationary plate 18 with an evacuation or gas extraction outlet 19 is provided at the upper-most part of the container 2. When the separator 1 is in use, this plate 18 provides atmospheric isolation of the apparatus, and a degassing function. The central portion 21 of the plate 18 passes above the bearing 22 of the core 3. At least the peripheral portion 23 of the plate 18 extends into the contents of the container 2 when in use.

An alternative form of the degassing components of the separator 1 is shown in FIG. 3. Here the plate 29 is affixed to the core 3 below the bearing 31, and so rotates with the core. The evacuation or gas extraction outlet 30 connects the interior with the exterior of the container via mud intake 24 and an upper part of the core 3.

To further improve the efficiency of degassing a partial vacuum may be introduced in the container, when in use, via the gas extraction outlet.

When the separator 1 of the invention is in use, drilling mud carrying solids material in the form of rock cuttings enters the core 3 through the mud intake 24 and passes down the rotating core 3 to the materials input means 12 via the lower radius arms 14. The speed of rotation of the container 2 is selected according to mud and pump rate conditions. With unweighted muds (no barite) maximum container speed is used for ultra-fine silt removal. With weighted muds, container speed is reduced to avoid barite separation.

The materials input means 12 serve to introduce mud and cuttings by centrifugal force into the mud pool with minimum turbulence. Angling of the input means as shown in FIGS. 1 and 2, is one way of helping to achieve this, although the present invention is not restricted to apparatus in which the input means are so angled. It will be appreciated that factors other than the angle of emission of material from the input means will also affect turbulence. For example, differences in the rates of rotation of the container and the central core, and the immediate environment into which material is emitted. Aspects of the present invention which address these factors are discussed below.

The input means 12 are submerged to provide internal atmospheric isolation for partial evacuation while degassing.

To further prevent turbulence from the materials input means 12 stirring up the contents of the collection chambers 7, an isolation plate 26 (as shown in FIG. 3) may be installed in the entrance to the lower portion of the chambers 7, to approximately the height of the lower radius arms 14.

The core 3 may rotate at approximately 5 rpm less than the speed of the container. A differential speed between the container 2 and wiping means 16 of approximately 100 feet per minute is then obtained.

It will be understood that when the separator is in use centrifugal force causes the mud pool to form into a substantially vertical cylinder, the depth of which is determined by the position of top weir plate 33.

As the mud travels upwards out of the separator solids are deposited on the wall of the container.

The wiping means 16, which contact the upper substantially cylindrical region 5 of the container 2 direct solids material to the lower region 6 where the collection chambers 7 are located. The upper region 5 therefore contains drilling mud which is progressively cleaner towards the uppermost part of the container 2 where cleaned mud is thrown over the top weir plate 33 by centrifugal force against a baffle plate 34 and into discharge outlet 4. The baffle plate 34 directs the ejected mud into the outlet and also minimises aeration of the mud at this point.

Solids material or cuttings in the mud pool at the lower region 6 of the container 2 is forced outwards by centrifugal force into the collection chambers 7. Sensors 11 sense the quantity of solids material in opposite pairs of collection chambers 7. A synchronised dump cycle is initiated to maintain rotational balance. The sensor 11, in the form of an electronic device extending into the collection chambers 7, determines when an opposing pair of collection chambers 7 are full, and activates the dump cycle.

The first step in the dump cycle is the isolation of an opposing pair of collection chambers 7 by closing the inner plates 10. The electrically driven discharge, gates 8 are then opened for that pair of opposing chambers. Only one pair of chambers are dumped at any one time. The dump cycle is completed by the reversal of this sequence.

It will be appreciated that for each collection chamber there must be careful synchronisation of the opening and closing of the inner plate 10 and the discharge gates 8, and this is preferably controlled automatically.

In FIG. 2, the pair of collection chambers 25 are shown with discharge gates 8 in an open position, while the remaining chambers have their discharge gates in the closed position. In FIG. 1, the inner plates 10 of the collection chambers 7 are shown in an open position **10*a* and a closed position 10*b***.

It will be appreciated that in the form of separator shown in FIG. 3 a dump cycle is much simpler, the contents of the whole annular collection chamber 32 being dumped in a single process. Again, the sensor 11 determines when the annular collection chamber 32 is full and initiates the dump cycle. The dump cycle then comprises isolation of the chamber 32 by closing the inner plate 27, opening the discharge gate 28 to dump the collected solids material, closing the discharge gate 28 and then reopening the inner plate 27.

The inner surfaces of the rotatable container 2 of the invention, including the collection chambers 7, may be lined with a friction reducing substance, for example polytetrafluoroethylene(TEFLON) or a plastics material. This restricts or prevents solids material from sticking to the inner surface of the container.

In an alternative embodiment the mud intake or rig flowline may be separate from the solids separator itself, discharging used mud and solids material into a conical-shaped entrance to the core. This conical-shaped entrance directs inlet mud into the core and prevents backflow. With this configuration there is no need for any bearing between the mud intake or rig flowline and the separator. There may also be a central inverted cone positioned in the core, below the entrance and about the central gas extraction outlet. This inverted cone would direct incoming mud into a vertically segmented outer part of the rotatable core. A central part of the core would be occluded so that mud could not enter this part. With this configuration mud in the core is given greater angular momentum before it enters the radius arms.

Further, the isolation plate 26, as shown in FIG. 3, may be replaced with a flow regulating ring. This ring would serve to dissipate turbulence of material flowing into the container and to adjust rotational speed of this material substantially to that of the container as the material flows into the upper solids separation part of the container. This flow regulating ring may comprise a substantially horizontally disposed barrier, in the form of a disc protruding from the inner side of the container above the materials input means, and substantially vertically disposed vanes positioned above and perpendicular to the barrier and extending towards the axis of the container to a greater extent than the barrier. Hence, material emitting from the materials input means must flow over the barrier and through the vertical means (rotating with the container) which adjust the rotational velocity of the material to that of the container before the material enters the upper part of the container. The flow regulating ring may be removable so that it may be replaced in the event of deterioration through fluid abrasion.

An additional modification envisaged is extension of the upper region of the walls of the container downwards to cover substantially the upper half of the entrance to the collection chamber(s). This ensures that solids material is deposited towards the middle of the chamber(s) rather than to one side.

A further modification envisaged is the use of shallower collection chamber(s), i.e. a reduced distance between the inner plate(s) and discharge gate(s) of the chamber(s). By reducing the ratio between the container diameter and the diameter between discharge gates of oppositely disposed collection chambers, or the diameter of a single annular discharge gate, the differential gravitational force at the container wall and the discharge gate(s) is reduced. This ratio may be varied to suit the particular conditions, but will typically be in the range of 1:2 to 1:1.2. Consequently, when the separator is working with weighted muds the tendency for barite separation to occur in the collection chamber(s) is reduced.

With unweighted muds considerable variation in the dimensions of the separator are therefore possible without detriment to its ability to effectively remove solids. However, with weighted muds it is preferable to employ a container of larger diameter (for example 3.5 m) and shallower collection chamber(s) to minimise loss of barite weight material.

The centrifugal solids separator and method of separating solids material from mud of the present invention is applicable to the drilling industry, and in particular to the oil industry. Conservation of drilling mud is of significance from both an economic and an environmental viewpoint. The apparatus and method of the present invention is designed to reduce mud loss and allow the recovery of used mud for reuse.

Although this invention has been described by way of example, and with particular reference to the preferred embodiments shown in the accompanying drawings, it is to be understood that modifications and variations may be made thereto without departing from the scope of the invention as described in the appended claims.

I claim:

1. A centrifugal solids separator adapted to separate drill cuttings from mud in a continuous drilling operation comprising: a container rotatable about its longitudinal axis; at least one materials input means for the input of mud and solids material to an inlet area of the container; one or more wiping means adjacent an internal surface of the container, rotatable about an axis coincident with that of the container and adapted to wipe deposited solids material from sides of the container at a solids separation area of the container during centrifugation; at least one collection means interconnectable with and rotatable with the container and adapted to receive and compact wiped solids material during centrifugation; control means adapted to control the depth of mud pool in the container during centrifugation; and at least one discharge outlet for the recovery of cleaned mud from the container.

2. A centrifugal solids separator according to claim 1 wherein the or each collection means is positioned between the inlet area and the discharge outlet for cleaned mud.

3. A centrifugal solids separator according to claim 2 wherein the or each collection means comprises a chamber positioned adjacent the sides of the container, a discharge means at an outer end of said chamber, and an inner plate adapted to isolate the chamber from the container, whereby said chamber may be isolated from the container and any collected and compacted solids material discharged through the discharge means without discontinuing centrifugation.

4. A centrifugal solids separator according to claim 3 wherein there is a single annular chamber, the discharge means and inner plate formed from two concentric cylinders movable between open and closed positions, the inner cylinder being the inner plate and the outer cylinder being the discharge means.

5. A centrifugal solids separator according to claim 3 wherein there are an even number of evenly spaced chambers, opposing pairs of chambers isolatable from the container by their corresponding inner plates, so that any solids material collected and compacted may be discharged through the discharge means of the isolated chambers substantially simultaneously, to maintain equilibrium.

6. A centrifugal solids separator according to claim 5 wherein the at least one materials input means comprises a central member positioned along the longitudinal axis of the container, and radial arms adapted to transfer mud and solids material from the central member to the inlet area of the container and emit said mud and solids material in the direction of rotation of the container when in use.

7. A centrifugal solids separator according to claim 6 wherein an inner part of the central member is occluded and an outer part is radially segmented so that mud and solids material entering the central member are confined to the outer radially segmented portion.

8. A centrifugal solids separator according to claim 7 wherein the central member is separately rotatable from the container.

9. A centrifugal solids separator according to claim 8 wherein the or each wiping means is connected to the central member and is further adapted to direct wiped solids material towards the at least one collection means.

10. A centrifugal solids separator according to claim 1 adapted to separate drill cuttings and gases from mud further comprising sealing means adapted to seal the container from the atmosphere when the separator is in use and an evacuation or gas extraction outlet in the sealing means for removal of entrained gases released from mud by partial evacuation of the sealed container during centrifugation.

11. A centrifugal solids separator according to claim 10 wherein the sealing means comprises a plate or plates extending from the longitudinal axis towards the sides of the container, adjacent an outer part or parts of the solids separation area, whereby when the separator is in use the or each plate extends into the mud pool.

12. A centrifugal solids separator according to claim 11 wherein inner surfaces of the container and the or each collection means are of a friction-reducing material.

13. A centrifugal solids separator according to claim 12 wherein the control means comprises at least one weir plate, located in an outer part of the solids separation area.

14. A centrifugal solids separator according to claim 13 further comprising rotational drive means to rotate at least the container.

15. A centrifugal solids separator adapted to separate drill cuttings from mud in a continuous drilling operation comprising:

a cylindrical container rotatable about its substantially vertical axis;

at least one materials input means for the input of mud and solids material to an inlet area at a lower part of the container;

one or more wiping means adjacent an internal surface of the container, rotatable about an axis coincident with that of the container and adapted to wipe deposited solids material from sides of the container at an upper solids separation area of the container during centrifugation and direct this solids material to at least one collection means;

said at least one collection means interconnectable with and rotatable with the container and adapted to receive and compact wiped solids material during centrifugation, and positioned between the inlet area and at least one discharge outlet for cleaned mud;

control means at an upper part of the container, adapted to control the depth of the mud pool in the container during centrifugation; and, the at least one discharge outlet for cleaned mud above the control means for recovery of cleaned mud from the container.

16. A method of continuously separating drill cuttings from mud comprising:

inputting used mud to a container;

rotating the container to produce a cylindrical mud pool in the container and to deposit solids material on sides of the container, by centrifugal force;

wiping the deposit of solids material from the sides of the container during centrifugation;

collecting and compacting the wiped solids material in at least one collection means rotatable with the container during centrifugation; and recovering cleaned mud via at least one discharge outlet of the container.

17. The method of claim 16 further comprising controlling a depth of the mud pool by control means.

18. The method of claim 17 further comprising dumping collected and compacted solids material from the or each collection means at intervals, in a dumping cycle, and during continuing centrifugation.

19. The method of claim 18 wherein the dumping cycle comprises monitoring the amount of solids material in the collection means, isolating substantially full collection means from the container, and discharging the solids material via discharge gates in the collection means.

20. The method of claim 19 wherein the dumping cycle is controlled and synchronised to maintain balance of the rotating container.

21. The method claim 20 further comprising controlling the input of used mud to the container to minimise turbulence in the mud pool.

22. The method of claim 21 further comprising at least partial evacuation of the container when in use to facilitate the removal of entrained gases from mud during centrifugation.

* * * * *